US005768728A

United States Patent [19]

Harwood et al.

[11] Patent Number: 5,768,728

[45] Date of Patent: Jun. 23, 1998

[54] WATER LEVEL DETERMINATION FOR LAUNDRY WASHING MACHINE

[75] Inventors: Jonathan David Harwood; Paul Stephen Hood, both of Auckland, New Zealand

[73] Assignee: Fisher & Paykel Limited, Auckland, New Zealand

[21] Appl. No.: 687,192

[22] Filed: Jul. 25, 1996

[51] Int. Cl.[6] ..... D06F 33/02

[52] U.S. Cl. ..... 8/158; 8/159; 68/12.04; 68/12.05

[58] Field of Search ..... 8/158, 159; 68/12.04, 68/12.05

[56] References Cited

U.S. PATENT DOCUMENTS

| | | | |
|---|---|---|---|
| 4,303,406 | 12/1981 | Ross | 68/12.05 X |
| 4,335,592 | 6/1982 | Torita | 68/12.18 |
| 4,779,430 | 10/1988 | Thuruta et al. | 68/12.04 |
| 4,862,710 | 9/1989 | Torita et al. | 68/12.04 X |
| 5,042,276 | 8/1991 | Kamano et al. | 68/12.05 X |
| 5,144,819 | 9/1992 | Hiyama et al. | 68/12.05 X |
| 5,161,393 | 11/1992 | Payne et al. | 68/12.05 X |
| 5,208,931 | 5/1993 | Williams et al. . | |
| 5,271,116 | 12/1993 | Williams et al. | 8/159 |
| 5,341,452 | 8/1994 | Ensor | 388/811 |

FOREIGN PATENT DOCUMENTS 61-263487 5/1985 Japan .

*Primary Examiner*—Philip R. Coe

*Attorney, Agent, or Firm*—Trexler, Bushnell, Giangiorgi & Blackstone, Ltd.

[57] ABSTRACT

A laundry washing machine in which a suitable level of water is automatically determined for any particular load size. The machine is operated to first determine an initial estimation of the clothes load and to then fill to a water level suitable to the initial load estimation. The machine is then operated in such a way to check if the estimated water level is actually sufficient for the clothes load, essentially by determining the resulting load on the laundry machine motor. If the water level is found to be insufficient, then more water is added before the checking routine is carried out once again. When the water level is determined to be suitable for the clothes load, washing is commenced.

21 Claims, 7 Drawing Sheets

WATER LEVEL DETERMINATION FOR LAUNDRY WASHING MACHINE

FIELD OF THE INVENTION

This invention relates to water level determination and especially though not solely to methods and apparatus for use in load sensing in domestic appliances such as laundry washing machines in order to determine a suitable water level to use for a particular load size during the washing cycle of a laundry washing machine to optimise washing performance.

DESCRIPTION OF THE PRIOR ART

Recently the operation of some laundry washing machines has become highly automated. A user need only turn the machine on, if necessary adjust a few user setable wash parameters at the touch of a button, and then initiate the washing cycle. The washing machine is programmed to automatically adjust or control such features as the instantaneous agitator torque dependent on the desired vigorousness of wash, spin tub speed independent of the wash load at predetermined spin speeds (for example 1000 rpm), and the temperature of the water supplied to the wash load in addition to further automatic washer functions which optimise wash performance for the particular load. An example of an automatic laundry washing machine which incorporates automatic features including the aforementioned functions is our washer sold under the trade mark SMART DRIVE.

One automatic feature of most washing machines which is presently being developed by laundry machine manufacturers is automatic determination of a suitable wash water level dependent on wash load. Water level has previously been left to the discretion of the operator, too low a level resulting in increased stress on the motor and inferior wash performance, too high a level meaning a waste of water and a longer overall length of the washing cycle.

Examples of existing automatic water level systems for laundry washing machines are disclosed in our prior U.S. Pat. Nos. 5,271,116 (Williams et al) and 5,208,931 (Williams et al). Methods of determining wash load from which an appropriate water level can be calculated disclosed in these patents include:

i) at a predetermined time during admission of water to the water container, accelerating the spin tub and clothes load to a predetermined velocity and then removing power from the motor and measuring the time taken for the rotatable assembly to attain zero rotational velocity, this time giving an indication of the container load.

ii) in machines of the type where the spin tub and agitator are "disconnected" upon admission of a sufficient volume of water to allow the agitator to float out of connection with the spin tub so that a spin cycle may be carried out with both agitator and spin tub rotating together, or a wash cycle to be carried out with only the agitator driven by the motor, measuring the time taken for "disconnection" to occur (once water admission is commenced) as this time will be influenced by the load of clothes on the spin tub base.

iii) in machines of the type mentioned above, measuring the level (or volume) of water required to disconnect the agitator from the spin tub as this level (or volume) will be influenced by the wash load resting on the spin tub base.

iv) determining the "viscosity" of the wash load during an agitation operation when the wash load is substantially immersed in wash liquid.

Further examples of prior attempts to automatically determine a suitable water level include:

U.S. Pat. No. 4,335,592 issued to Torita

A predetermined amount of water is admitted to the water container. The agitator is then rotated for a fixed period of time and the number of rotations counted. Water is then admitted to the water container in inverse proportion to the number of rotations observed.

U.S. Pat. No. 4,862,710 issued to Torita et al

The voltage across terminals of the motor is detected during the spinning cycle. This voltage varies with load. The appropriate water level is then determined and utilised in a subsequent cycle of the machine.

U.S. Pat. No. 4,779,430 issued to Thuruta et al

A magnet mounted on the moving motor shaft induces voltage across a coil. During agitation this induced voltage is monitored when power is removed from the motor at which time the time taken for the induced voltage to drop below a threshold voltage is measured. This time is indicative of load.

Japanese Patent Publication JP61-273487 to Matsushita

The motor current is filtered to extract a specific component centred on a frequency dependent on the number of stirring blades and the rotational speed.

U.S. Pat. No. 4,303,406 issued to Ross

Water is directed on to the surface of the washing load. Some water is absorbed by the load of clothes and some water passes through the clothes to accumulate in the water container. The time taken for the water level in the water container to reach a predetermined level is dependent on the fabric load.

Each of the above methods suffer from inaccuracy and/or inconsistency. For example, methods which require the clothes load to be resting on the spin tub base are inaccurate as the agitator base will support some of the load and this part of the load will not be registered in machines where the agitator is directly coupled to the shaft assembly and motor.

BRIEF SUMMARY OF THE INVENTION

It is, therefore, an object of the present invention to provide a method and apparatus for determining a suitable water level for a wash load in a laundry washing machine which goes at least some way towards overcoming the above disadvantages or which will at least provide the public with a useful choice.

Accordingly, in a first aspect, the invention consists in a method of determining a suitable fluid level for washing a load of laundry in a laundry washing machine having a rotatable spin tub which receives said laundry and is situated within a stationary water container, an agitator rotatable within said spin tub which is rotatable with said spin tub during a spinning phase of said laundry washing machine or rotatable independently of said spin tub during an agitation phase, a motor connected to drive said agitator and said spin tub when required and control means automating operation of said laundry washing machine, said method comprising the steps of:

i) obtaining an initial indication of the load of said laundry within said spin tub and transmitting said initial indication to said control means, ii) admitting washing fluid to said water container upon instruction by said control means to an initial level influenced by said initial indication of the load, iii) measuring the value of a physical characteristic of the laundry load and washing fluid mixture and transmitting said value to said control means, iv) determining said suitable fluid level by said control means operating on the value of said physical characteristic In a second aspect the invention consists in a method of determining a suitable water level for a given sized laundry load in a laundry washing machine having an electric motor driving a vertical shaft, while in an agitation phase of a washing cycle, said agitation phase defined by a desired agitator velocity versus time profile having a ramp portion from substantially zero velocity to a plateau velocity, a plateau portion substantially at said plateau velocity for a predetermined length of time and a coast period in which motor power is removed and motor velocity drops towards zero, said method comprising the steps of:

i) accelerating said motor through said ramp portion, ii) determining the value of a characteristic of the overshoot of the motor velocity past said plateau velocity, and iii) adding washing fluid to said laundry load if the value of said characteristic lies outside predetermined threshold boundaries.

In a third aspect, the invention consists in a laundry washing machine having a rotatable spin tub which receives a laundry load for washing within a stationary water container, an agitator rotatable within said spin tub which is rotatable with said spin tub during a spinning phase of said laundry washing machine or rotatable independently of said spin tub during an agitation phase, a motor connected to drive said agitator and said spin tub when required and control means automating operation of said laundry washing machine and storing a program which causes the controller to:

i) obtain an initial indication of the load of said laundry within said spin tub and transmitting said initial indication to said control means, ii) admit washing fluid to said water container upon instruction by said control means to an initial level influenced by said initial indication of the load, iii) measure the value of a physical characteristic of the laundry load and washing fluid mixture and transmitting said value to said control means, iv) determine said suitable fluid level by said control means operating on the value of said physical characteristic.

The invention consists in the foregoing and also envisages constructions of which the following gives examples.

BRIEF DESCRIPTION OF THE DRAWINGS

One preferred form of the present invention will now be described with reference to the accompanying drawings in which.

DETAILED DESCRIPTION OF THE INVENTION

Figure 7:
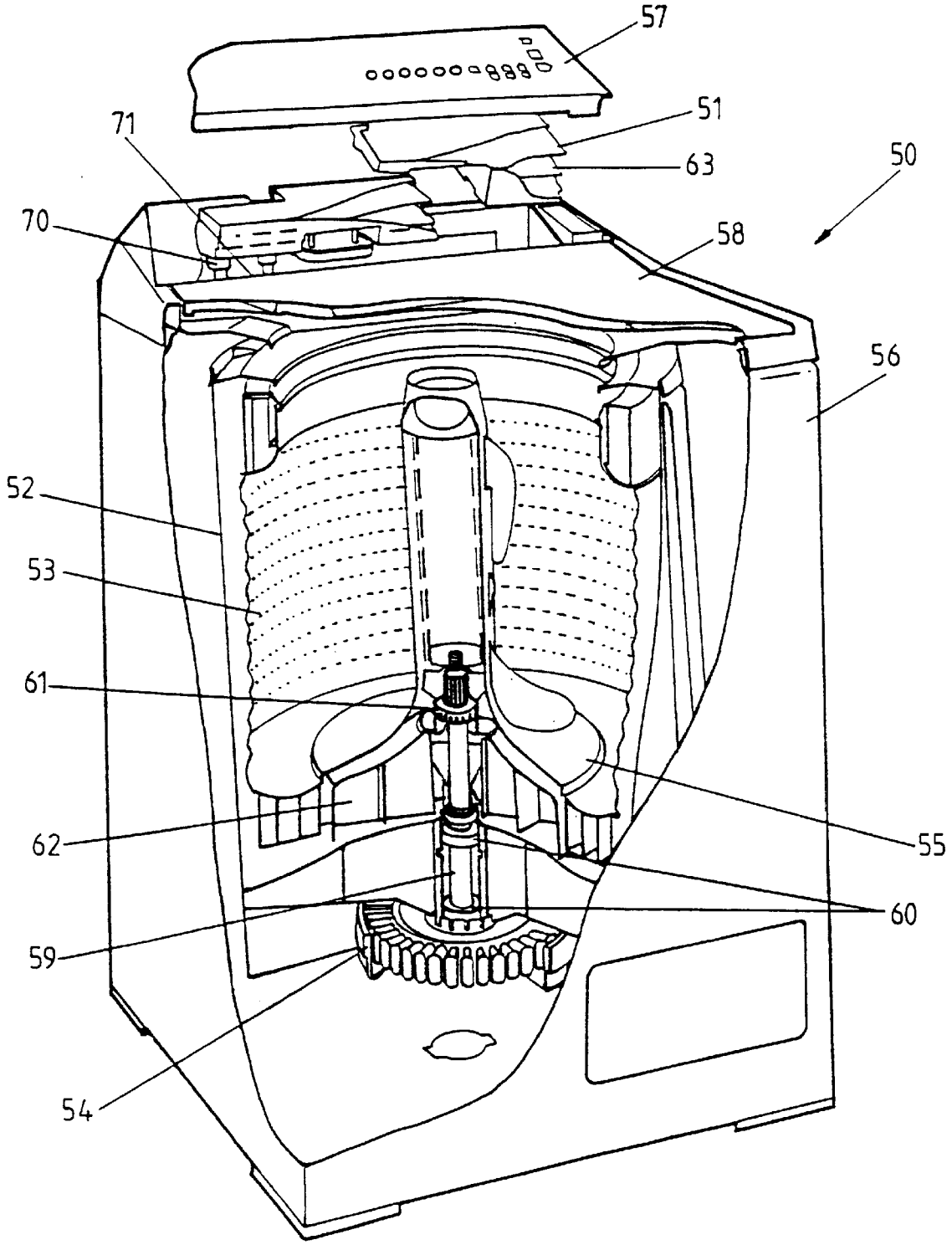
FIG. 7 is a partially cut away partial exploded perspective view of a laundry washing machine including a control means programmed to carry out the steps of the flow chart shown in FIG. 1.

With reference to FIG. 7 a laundry washing machine generally referenced 50 is shown comprising a cabinet 56 in which a stationary water container 52 is suspended by suspension rods (not shown) from an upper part of cabinet 56 beneath a control panel 57 (which allows users to set various wash parameters as will be described later) are hot and cold water inlet valves 70 and 71. Within the water container 52 is a rotatable spin tub 53 which accepts a laundry load and through which a drive shaft 59 passes. The drive shaft 59 then passes through the base of water container 52 and a motor 54 is attached at the lower end of the shaft. The preferred motor is of the electronically commutated inside out permanent magnet rotor type, the rotor being directly attached to the drive shaft 59 while the stator is fixedly connected to the underside of water container 52. Motor 54 is preferably driven by pulse width modulation in a manner disclosed in our U.S. Pat. No 5,341,452 issued to Ensor the disclosure of which is incorporated herein by reference. This electronic control system allows for small incremental changes in speed to be made and the controller described allows for monitoring of speeds and elapsed times. The system disclosed also allows for motor speed to be controlled and monitored (by for example monitoring the commutation rate) and this fact is utilised in the system described below. Water container 52 is sealed against the drive shaft 59 by a single pair of water sealed bearings 60. A water outlet and pump (not shown) are provided to empty the machine of water during and at the completion of the washing cycle.

Within spin tub 53, covering and connected to the upper splined end of drive shaft 59 is an agitator 55. A dog clutch arrangement 61 selectively interlocks agitator 55 and spin tub 53. The dog clutch consists of two sets of opposing complementary teeth, a first upwardly facing set of teeth on the drive shaft interlocking with a second corresponding downwardly facing set of teeth on a part of the base of spin tub 53. The underside of the base of the spin tub 53 is provided with a series of floatation chambers which allow the spin tub to "float" when washing fluid enters the water container. The dog clutch allows the spin tub 53 and agitator 55 to be rotated together (when connected) or only the agitator to be rotated if required (when the upper part of the dog clutch is raised out of connection with the lower teeth on the shaft). In FIG. 7 there is no water within the water container 52 and as a result the dog clutch 61 is engaged so that the spin tub and agitator will be rotated together upon energisation of motor 54.

As washing fluid, for example water, is directed into the laundry machine, the level of water collected in the water container 52 will eventually reach a level where floatation chambers 62 in the base of the spin tub supply a sufficient upward buoyancy force to overcome the downwardly directed weight of the spin tub and laundry load. Thus when the water container receives at least a sufficient amount of water to float the spin tub, energisation of the motor 54 allows the agitator to be oscillated for a wash cycle with the spin tub (being decoupled from the shaft) receiving no rotational energy directly from the motor (although a fluid coupling may exist causing the spin tub to rotate). When the water container is empty (or substantially empty) of water, energisation of motor 54 allows a spinning operation to be carried out where both agitator and spin tub are rotated together at a high speed to centrifugally extract washing fluid from the laundry load.

From the drawing it can be seen that the base of agitator 55 covers a substantial proportion of the spin tub base. In smaller laundry machine models the agitator is often the same (standard) size as in larger model machines and, therefore, the proportion of the spin tub base taken up by the agitator in smaller models is even greater. The fact that the agitator base covers much of the spin tub base makes conventional load determination in laundry machines (where the weight of fluid and load are physically measured) a problem as the agitator in this machine is fixedly coupled to the shaft and therefore any laundry load thereon cannot be detected by conventional means which would only detect the load on the spin tub base and side walls.

A fluid level measuring means or pressure transducer 63 receives input from the surface of the fluid within the water container and outputs a level signal to a control means 51. The incremental output of pressure transducer 63 provides pressure values which correspond to minimum water level increments of, for example, 3 mm although in the preferred form of the present invention actual possible water levels are quantised to 5 discrete levels being LOW, LOW/MEDIUM, MEDIUM, MEDIUM HIGH and HIGH. Control means 51 includes a microprocessor with associated input/output ports, logic circuitry and memory modules which are not individually shown for clarity. The control means 51 receives input from control panel 57 where a user may input wash parameters such as the maximum required spin speed, wash temperature and vigorousness of wash (for example regular, delicate or heavy duty) by pressing a series of buttons. Control means 51 executes a software program stored in memory which accepts these inputs and controls each of the electronic components of the laundry machine during a washing cycle according to the user settings including such functions as motor speed control and water temperature. A further automated function of the laundry washing machine according to the present invention is its ability to determine a suitable washing fluid level based on the load of laundry within the machine prior to a washing sequence commencing. The operation of the machine to accomplish this "automatic water level" function will now be described with reference to FIGS. 1 to 6.

Figure 1:
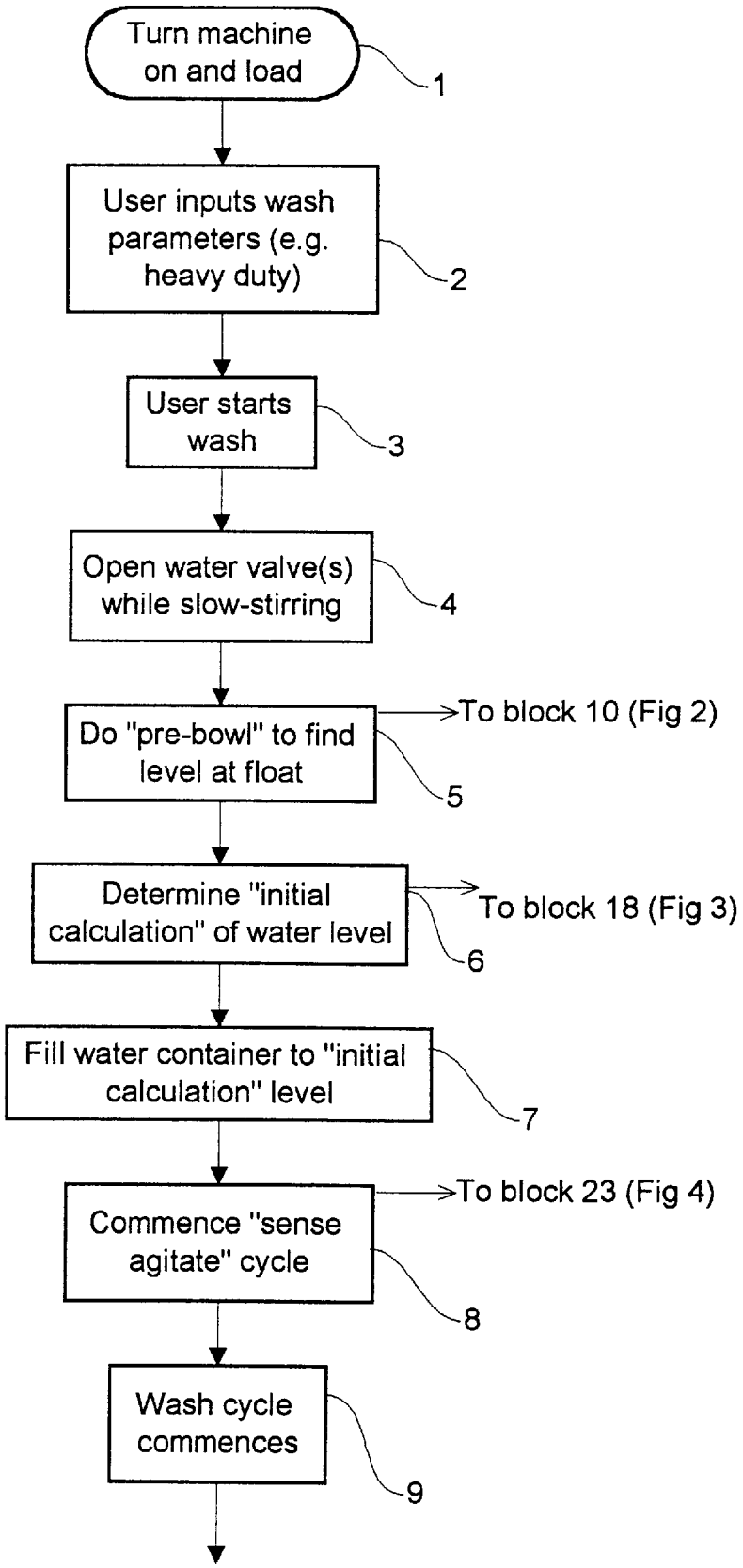
FIG. 1 is a flow chart showing the overall operation of a laundry washing machine according to the present invention.

FIG. 1 outlines the main steps carried out during operation of a laundry washing machine programmed in accordance with the preferred form of the present invention. At block 1 the machine is turned on initiating execution of the program. Concurrently, the user loads the spin tub of the machine with laundry to be washed. Prior to commencing the laundering cycle at block 3, the user enters desired wash parameters to the control means 51 by, for example, push button switches on control panel 57. A series of indicators, for example, LEDs on control panel 57 display the user's settings.

Figure 2:
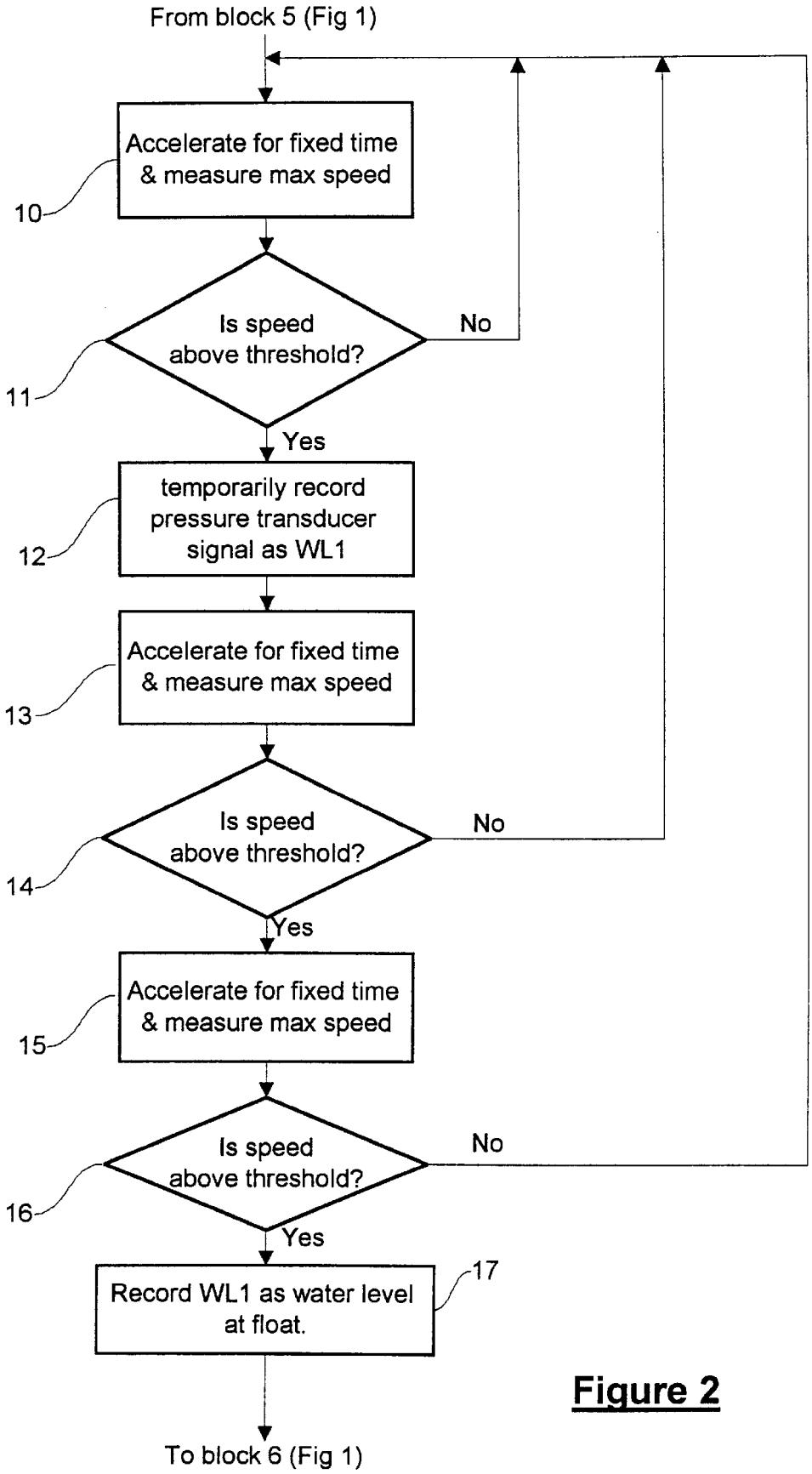
FIG. 2 is a flow chart showing the steps involved in the "pre-bowl" block (block 5) of the flow chart in FIG. 1.
Figure 3:
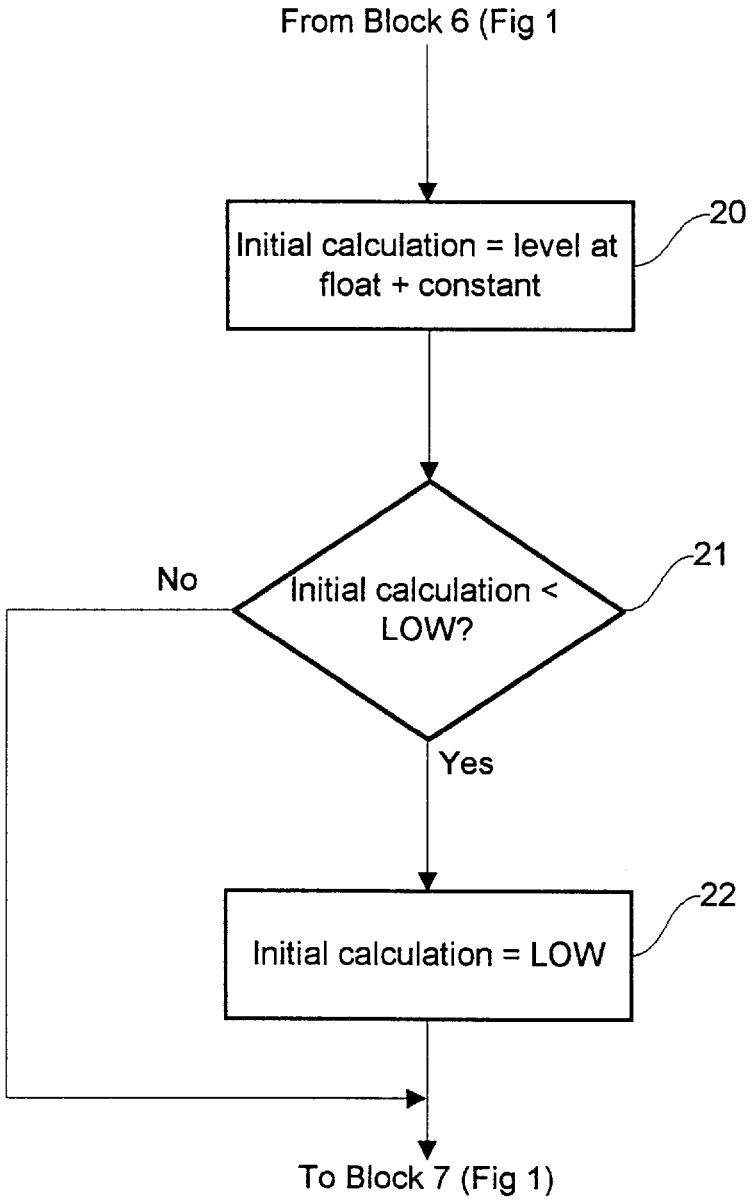
FIG. 3 is a flow chart showing the steps involved in the "initial calculation" block (block 6) of the flow chart in FIG. 1.

Once the wash starts the control means controls the opening of hot and cold water inlet valves in a manner such that the desired water temperature (set or selected by the user) is achieved at block 4. While water is admitted to the water container, the motor is energised and motor speed is controlled to achieve a rotational velocity of, for example, 20 rpm. It should be noted that the speed of the motor could be determined by hall sensors or back EMF sensors as is well known and this speed is fed back to control means 51. This "slow stir" allows for a uniform distribution of water while filling so that all of the laundry load has the opportunity to be wetted. As has been described previously, due to the lack of water in the water container at start up, the dog clutch arrangement 61 will be engaged and energisation of the motor will cause the spin tub and agitator to be rotated together until an amount of water sufficient to overcome the downwardly directed forces on the spin tub has been admitted to the water container. At block 5 an effort is made to determine the level of water required to cause the previously described "disconnection" of spin tub and agitator. FIG. 2 explains this process in greater detail as will now be described.

Occasionally during the previously mentioned "slow stir" procedure, a substantially fixed amount of energy is input to the motor to cause acceleration of the motor, spin tub, agitator and laundry load/water mixture at block 10 over a short fixed period of time. The maximum speed attained by the motor will be influenced by the weight of the total rotatable assembly and laundry load/water mixture. The motor speed is sensed and compared to a predetermined threshold value (for example 200 rpm) at block 11. The threshold speed may, for example, be experimentally found as the maximum speed which would be attained upon the input of the fixed amount of energy to the motor of the laundry machine with no laundry load. If the maximum speed reached is below this threshold then control returns to block 10, but if the threshold is exceeded the present water level signal from pressure transducer 63 is temporarily recorded as WL1 by control means 51. As the threshold has been exceeded it is likely that disconnection has occurred but in order to minimise the likelihood of a spurious reading and thus the agitator and spin tub still being connected, two further periods of acceleration are carried out in blocks 13 and 15.

Only if the determinations in three sequential decisions made in blocks 11, 14 and 16 reveal that the maximum speed has exceeded the threshold on three consecutive occasions will the control means accept that disconnection has actually occurred. If either of the decisions at blocks 14 or 16 reveal that the maximum speed is now less than the threshold, then the previous measurements may have been in error and the process is started afresh at block 11. In block 17 the previously, temporarily recorded value WL1 is recorded as the water level at float (WLAF) and the water inlet valves are closed.

Returning now to FIG. 1, once the water level at float (WLAF) has been determined, a coarse initial estimate is made of a suitable water level for the present load of clothes. This "initial calculation" level is determined with reference to, for example, an equation or a look-up table stored in memory indexed by water level at float By experimentation, we have found that a desirable "initial calculation" level (I) is calculated in accordance with the following linear function (as shown in block 20 of FIG. 3).

$$I=WLAF+K$$

where

K=63 mm for a 5 kg load machine

K=59 mm for a 6 kg load machine

K=53 mm for a 7 kg load machine

The calculated water level is then rounded up to the nearest discrete level (for example MEDIUM/HIGH).

There is, however, a minimum allowable level of water during a washing cycle (LOW water level) and if the value of Initial Calculation (1) is determined to be below this in block 21, then I is assigned this minimum LOW level at block 22 before control returns to the main loop of FIG. 1 at block 7.

At block 7 of FIG. 1, the water valves are reopened in appropriate proportions to produce the required temperature until the initial calculation water level is sensed by pressure transducer 63 via control means 51. Once the initial calculation water level has been reached, block 8 commences a fine adjustment process (termed "sense agitate") wherein the water level most suitable for the current laundry load is hoped to be reached.

Figure 4:
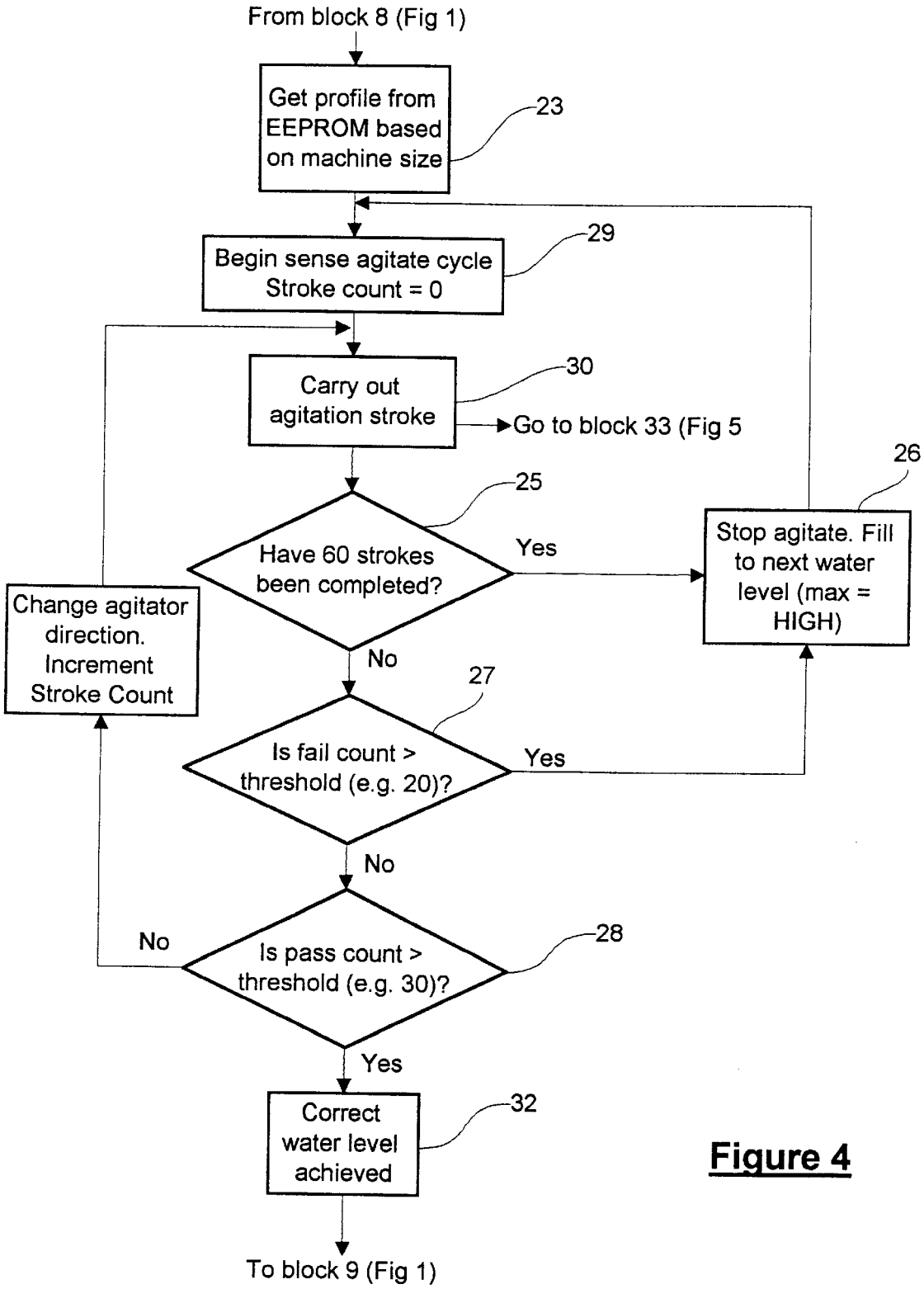
FIG. 4 is a flow chart showing the steps involved in the "sense agitate" block (block 8) of the flow chart in FIG. 1.

Referring to block 23 of FIG. 4, a required agitator velocity profile is read from an Electrically Erasable Programmable Read Only Memory (EEPROM) connected to control means 51. The EEPROM contains parameters which define, for example, three different velocity profiles for three different sized laundry machines, 5 kg load, 6 kg load and 7 kg load. Depending on the present machine size the appropriate velocity profile is read from memory. An example agitator velocity profile is shown in FIG. 6 and will be explained below. At block 29 a "sense agitate" cycle is commenced which attempts to determine the most suitable water level for the present laundry load essentially by investigating the loading on the motor and iteratively incrementing the water level if the motor is found to be overloaded as described below. At block 30 energy is supplied to motor 54 to produce an agitation action. Energy supply to the motor is varied in an attempt to maintain agitator velocity at or near the selected velocity versus time profile as defined in FIG. 5.

Figure 5:
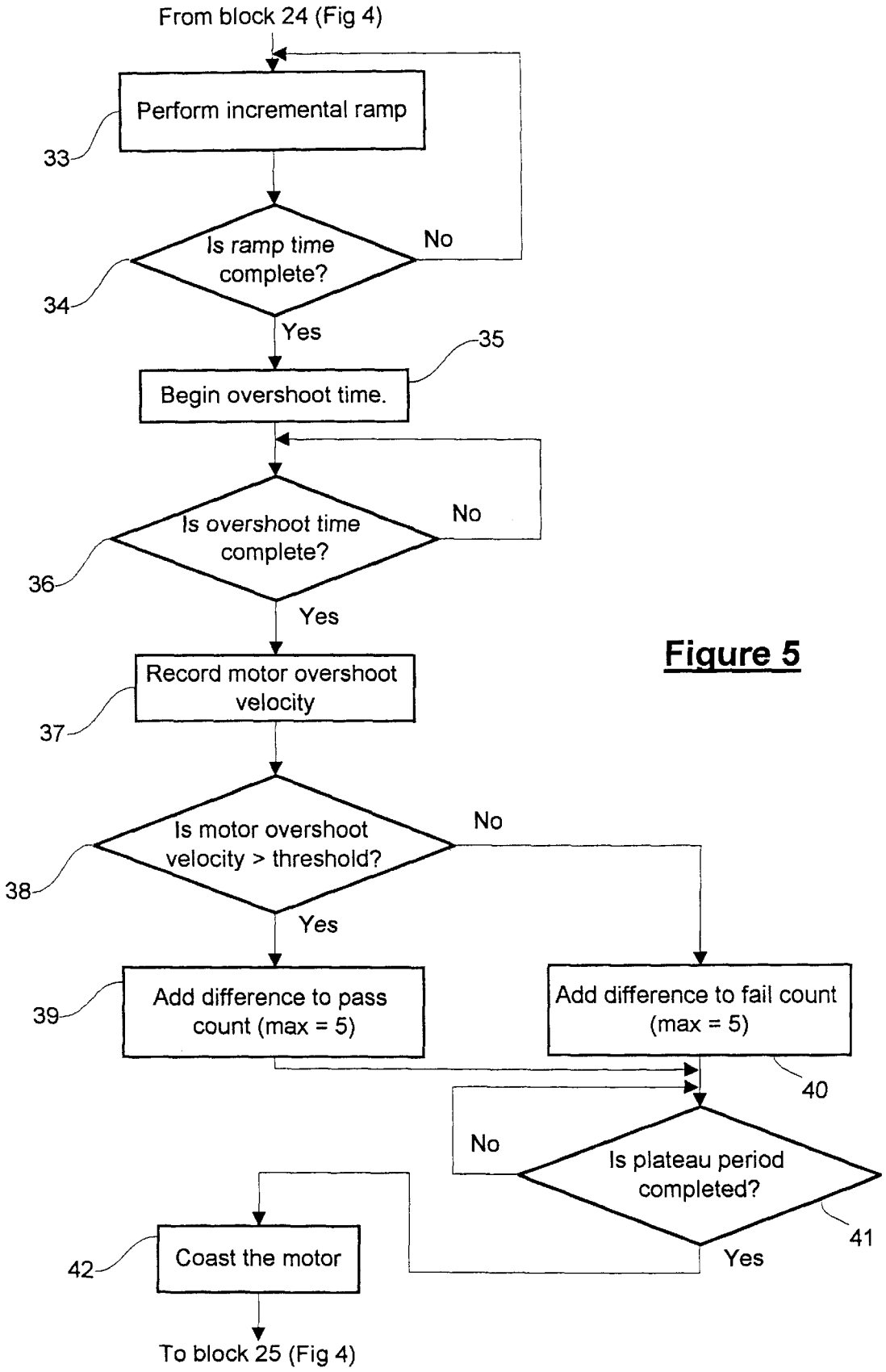
FIG. 5 is a flow chart showing the steps involved in the "wash profile" block (block 24) of the flow chart in FIG. 4.
Figure 6:
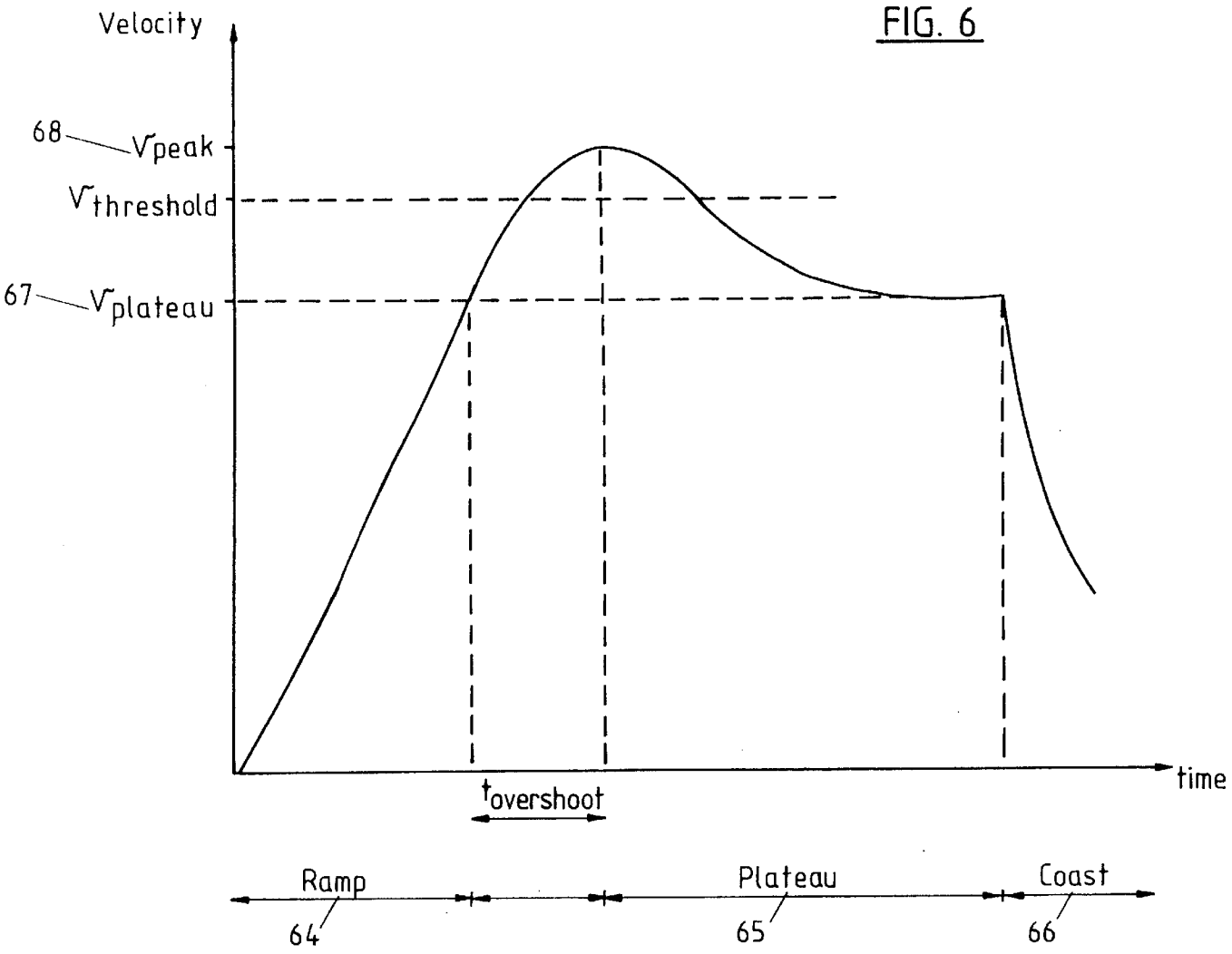
FIG. 6 is a graph of rotational velocity versus time for the agitator used in the laundry washing machine whose operation is detailed in FIG. 1 during one agitation stroke.

In order to appreciate the process described in FIG. 5 it is first necessary to explain the velocity profile graph of FIG. 6. With reference to FIG. 6 a rotational velocity (in meters per second or radians per second) versus time graph (or velocity profile) for an agitator is shown for one stroke of the agitator, that is for rotational displacement of the agitator in one direction. The profile is divided up into three regions, the first region is the ramp region over time range 64. The ramp region commences when the agitator has substantially zero rotational velocity and continues during uniform acceleration to a plateau velocity 67 ($\upsilon_{plateau}$). The ramp is actually a series of incremental steps produced by incremental increases in the PWM voltage applied to the motor as explained in our previously referred to U.S. Pat. No. 5,341,452. The second portion of the profile is the plateau region. Ideally during this plateau period of time in the range 65 the rotational velocity would be constant at ($\upsilon_{plateau}$). In reality some overshoot will occur in the region 69 ($t_{overshoot}$) reaching a peak speed 68 ($\upsilon_{peak}$). The third and final portion of the profile is the coast region which has the time range 66. During coast, power is removed from the motor windings and motor speed coasts down towards zero rpm.

The profile selected for the washing cycle maximises the quality of washing for a given machine size. The user input vigorousness of wash variable may adjust, for example, the plateau period 65 and the ramp period 64. A quick ramp and short plateau resulting in a heavy duty wash whereas a slow ramp and long plateau result in a gentle wash.

Referring again to FIG. 5 at block 33 the ramp portion of the agitator profile is commenced. When the plateau speed is reached, decision block 34 passes control to block 35. At block 35 a timer is started. In block 36 a loop is entered and only exited once the motor velocity peaks. The peak velocity may be determined by for example observing adjacent discrete velocities and noting when a decrease occurs or, more preferably, by obtaining the motor speed at a fixed time after the plateau time commences. This fixed time is referred to as $t_{overshoot}$ in the figures.

The motor overshoot velocity in the plateau region after $t_{overshoot}$ is recorded at block 37 and in decision block 38 the recorded peak velocity is compared to a predetermined threshold velocity. The predetermined threshold velocity ($\upsilon_{threshold}$) is a value arrived at by adding a constant to the plateau velocity $\upsilon_{plateau}$. The constant is a parameter stored in one of three tables in memory, one for each machine size (5 kg, 6 kg and 7 kg), each of the tables holding a different constant for each of the discrete water levels LOW, LOW/MEDIUM, MEDIUM and MEDIUM/HIGH. There is no constant for HIGH water level as once the water level is at HIGH there is no need to attempt to adjust the water level any further.

If at block 38 the overshoot velocity is found to be greater than the threshold value for the particular load in the particular size laundry washing machine then the present water level may be sufficient for the present load. Accordingly the value of the difference between the overshoot velocity and the threshold velocity is added to a "pass count" accumulator (or running total) in control means 51 at block 39. If, however, the overshoot velocity is less than the threshold velocity, revealing that the motor is perhaps overloaded as the present water level is too low, then the difference between the actual velocity and the threshold is added to a "fail count" accumulator at block 40. In order to minimise the effect of extreme results, only differences in velocity of a maximum of 5 speed counts (approximately 7 revolutions per minute) are added to either accumulator. Block 41 then determines if the plateau period is completed and if so, then the motor is coasted at block 42 before control passes to block 25 of FIG. 4.

In decision block 25, if 60 agitation strokes have been completed then at block 26 water is added to lift the water level to the next higher discrete water level and control passes to block 29 where the "sense agitate" cycle is restarted, hopefully more successfully as the aim is to exit the sense agitate cycle before the end of 60 agitation strokes (the reason will soon become clear). If 60 strokes have not yet been completed then at block 27 the accumulated fail count is compared to a fail threshold (for example 20). If the fail count is greater than the fail threshold then the sense agitate cycle is exited via block 26 where the water level is raised to the next highest discrete water level and sense agitate is started afresh at block 29.

If the fail count has not exceeded the fail threshold at block 27 then control passes to block 28. In block 28 the present pass count value is compared to a pass threshold value (for example 30). If the pass count exceeds the pass threshold then the present water level is adequate and the sense agitate cycle is exited by passing control back to the flow chart of FIG. 1 at block 9. If the pass count has not exceeded the pass threshold then control passes to block 24 where the agitator direction is reversed and the next stroke in the sense agitate cycle is carried out at block 30 through FIG. 5.

We have found that best results are derived from the sense agitate cycle if velocity readings are taken only from "strokes" in one direction (due to asymmetry of the motor). Therefore, the above method should preferably be carried out for all strokes but only velocities from each second stroke should be used for analysis and determination of suitable water level. It should be noted that the user may be allowed some control over the selection of appropriate water level by allowing the user to adjust the previously mentioned constants which are added to the plateau velocity $\upsilon_{plateau}$. If it appears to the user that the water level determined by the washing machine for a particular size load is insufficient, then input from the user via control panel 57 can alter the value of the aforementioned constants. For example, a button may be provided to increase the value of the constant so that the suitable water level will consistently be determined at a level a little higher than "usual" and a further button to decrease the value of the constant.

When the "sense agitate" cycle has ended and before block 9 of FIG. 1 is started a "mix up agitate" period (of for example 1 minute in duration) may be carried out comprising a series of agitation strokes designed to uniformly distribute the washing load in the washing fluid. A further "sense agitate" cycle may then be carried out in order to ensure that the previously determined water level was not in error due to non-uniform distribution of the load around the agitator. Once the second "sense agitate" cycle is completed (and extra water added if required) then the water level should be at the most suitable level for the present clothes load.

Once the correct level has been achieved, the true agitation part of the washing cycle is commenced in the known way at block 9 of FIG. 1, utilising the previously described agitator velocity profile. The washing cycle may include subsequent spinning, deep rinsing, spray rinsing and further agitation segments. The correct water level value determined by the above "sense agitate" process may be stored in memory and utilised in subsequent segments which require it in order to avoid the need to repeat the sensing process. Accordingly, the correct water level is stored in a memory of control means 51 during the remainder of the washing cycle.

However, if the user decides to add further laundry to the washing machine after it has started the agitation segment of the washing cycle, then the stored value of water level may not be suitable to the new load. Accordingly, the present invention includes monitoring for this occurrence. If, after agitation has commenced, the laundry washing machine's lid is opened (sensed by the change of state of a switch or proximity sensor beneath the lid), control means 51 causes the previously described "sense agitate" cycle to be repeated so that more water may be added if required. It should be noted that water could be removed if part of the load had been removed. Therefore, the laundry washing machine of the present invention is able to constantly monitor the laundry load by detecting the motor loading during an agitate cycle and adjusts the water level accordingly.

It should also be noted that as the present invention provides control means 51 with a water level value which is suitable for the load of laundry within the machine, this value could be used in conjunction with an automatic detergent dispenser which could be actuated by control means 51 to dispense an amount of detergent suitable to the load.

The present invention has obvious advantages for the user as the laundry washing machine will require less user input and is able to adjust water level during a wash without user input. In addition users will receive a more consistent and higher quality level of washing as the laundry washing machine will always select the same suitable level for a given laundry load in contrast with a machine which requires the user to estimate a water level for the machine to use. It should be noted that the pass/fail criteria for the "sense agitate" cycle are weighted towards fail so that water level will be a little too high rather than too low in borderline cases. Furthermore three distinct levels of accuracy for water level determination have been disclosed. The most basic is the water level at float, a more accurate level is determined with the sense agitate cycle and an even better determination is achieved by adding a short standard agitation period after the sense agitate cycle and then repeating the sense agitate cycle.

We claim:

1. A method of determining a suitable fluid level for washing a load of laundry in a laundry washing machine having a rotatable spin tub which receives said laundry and is situated within a stationary water container, an agitator rotatable within said spin tub which is rotatable with said spin tub during a spinning phase of said laundry washing machine or rotatable independently of said spin tub during an agitation phase, said agitation phase defined by a desired agitator velocity versus time profile having a first ramp portion of substantially linear acceleration from substantially zero velocity up to a desired plateau velocity, a second plateau portion of substantially constant velocity lasting for a predetermined time period and a third coast period in which motor power is removed and rotational velocity drops to substantially zero, a motor connected to drive said agitator and said spin tub when required and control means automating operation of said laundry washing machine, said method comprising the step of:

i) obtaining an initial indication of the load of said laundry within said spin tub and transmitting said initial indication to said control means, ii) admitting washing fluid to said water container upon instruction by said control means to an initial level influenced by said initial indication of the load, iii) setting a threshold velocity above said plateau velocity, iv) supplying power to said motor to produce agitator velocity in accordance with said desired agitation velocity versus time profile and determining the difference between said threshold velocity and the actual motor velocity after a predetermined time after the start of said plateau period, v) adding said difference to one of two accumulators depending on whether said actual motor velocity after said predetermined time is greater than or less than said threshold velocity, vi) reversing direction of said motor and repeating steps (iv) to (vi) until either of said two accumulators reach predetermined threshold values, and vii) determining whether said suitable fluid level has been reached based on the contents of said accumulators.

2. A method of determining a suitable fluid level for washing a load of laundry in a laundry washing machine as claimed in claim 1 wherein said laundry washing machine includes fluid level measuring means, and upon an amount of washing fluid entering said water container sufficient to float said spin tub and said laundry load out of connection with said agitator said spin tub and agitator are disconnected to allow said independent rotation and said step of obtaining an initial indication of said laundry load comprises said fluid level determining means determining the level of washing fluid in said water container at the moment disconnection occurs and transmitting said level at disconnection to said control means.

3. A method of determining a suitable fluid level for washing a load of laundry in a laundry washing machine as claimed in claim 1 or claim 2 wherein said method also includes the step of monitoring said laundry washing machine for changes in said load of laundry and upon determination of a change in said load repeating steps (iii) and (iv) to determine a new suitable fluid level.

4. A method of determining a suitable fluid level for washing a load of laundry in a laundry washing machine as claimed in claim 3 wherein said step of obtaining an initial indication of the load of said laundry includes the step of admitting washing fluid to said water container while slowly rotating said spin tub and said agitator.

5. A method of determining a suitable fluid level for washing a load of laundry in a laundry washing machine as claimed in claim 1 or 2 wherein said step of adding said difference to one of two accumulators is only carried out if said difference is below a predetermined limit.

6. A method of determining a suitable water level for a given sized laundry load in a laundry washing machine having an electric motor driving a vertical shaft, while in an agitation phase of a washing cycle, said agitation phase defined by a desired agitator velocity versus time profile having a ramp portion from substantially zero velocity to a plateau velocity, a plateau portion substantially at said plateau velocity for a predetermined length of time and a coast period in which motor power is removed and motor velocity drops towards zero, said method comprising the steps of:

i) accelerating said motor through said ramp portion, ii) determining the value of a characteristic of the overshoot of the motor velocity past said plateau velocity, and iii) adding washing fluid to said laundry load if the value of said characteristic lies outside predetermined threshold boundaries.

7. A method of determining a suitable water level for a given sized laundry load, in a laundry washing machine as claimed in claim 6 wherein said method includes a first step of admitting washing fluid to said laundry load to an initial level.

8. A method of determining a suitable water level for a given sized laundry load, in a laundry washing machine as in claim 7 wherein an agitator is connected to the upper end of said vertical shaft within a rotatable spin tub which is selectively connected to said vertical shaft said spin tub and agitator being located within a water container suspended from an upper part of said laundry washing machine, said water container including fluid level measuring means connected to pass level information to control means, and upon an amount of washing fluid entering said water container sufficient to float said spin tub and said laundry load out of connection with said agitator said spin tub and agitator are disconnected to allow independent rotation thereof and said step of admitting washing fluid to said laundry load to an initial level comprises said fluid level determining means determining the level of washing fluid in said water container at the moment disconnection occurs and transmitting said level at disconnection to said control means.

9. A method of determining a suitable water level for a given sized laundry load, in a laundry washing machine as claimed in claim 6 or claim 7 wherein said characteristic of the overshoot of motor velocity comprises the difference between a predetermined threshold velocity and the velocity of said motor at a predetermined time after the start of said plateau period.

10. A method of determining a suitable water level for a given sized laundry load, in a laundry washing machine as claimed in claim 6 or claim 7 wherein said step of determining the value of a characteristic of the overshoot comprises the steps of:

a) setting a threshold velocity above said plateau velocity, b) supplying power to said motor to produce agitation velocity in accordance with said desired agitator velocity versus time profile and determining the difference between said threshold velocity and the actual motor velocity after a predetermined time after the start of said plateau period, c) adding said difference to one of two accumulators depending on whether said actual motor velocity after said predetermined time is greater than or less than said threshold velocity, d) reversing direction of said motor and repeating steps (b) and (c) on consecutive agitator strokes until either of said two accumulators reach a threshold value.

11. A method of determining a suitable water level for a given sized laundry load, in a laundry washing machine as claimed in claim 10 wherein said step of adding said difference to one of two accumulators is only carried out for agitator strokes in one predetermined direction of rotation.

12. A method of determining a suitable water level for a given sized laundry load, in a laundry washing machine as claimed in claim 6 or claim 7 wherein said step of adding washing fluid to said laundry load comprises adding washing fluid to said water container if the accumulator summing difference values from velocities less than said threshold velocity reaches a predetermined upper limit.

13. A laundry washing machine having a rotatable spin tub which receives a laundry load for washing within a stationary water container, an agitator rotatable within said spin tub which is rotatable with said spin tub during a spinning phase of said laundry washing machine or rotatable independently of said spin tub during an agitation phase, said agitation phase defined by a desired agitator velocity versus time profile having a first ramp portion of substantially linear acceleration from substantially zero velocity up to a desired plateau velocity, a second plateau portion of substantially constant velocity lasting for a predetermined time period and a third coast period in which motor power is removed and rotational velocity drops to substantially zero, a motor connected to drive said agitator and said spin tub when required and control means automating operation of said laundry washing machine and storing a program which causes the controller to:

i) obtain an initial indication of the load of said laundry within said spin tub and transmitting said initial indication to said control means, ii) admit washing fluid to said water container upon instruction by said control means to an initial level influenced by said initial indication of the load, iii) set a threshold velocity above said plateau velocity, iv) supply power to said motor to produce agitator velocity in accordance with said desired agitation velocity versus time profile and determine the difference between said threshold velocity and the actual motor velocity after a predetermined time after the start of said plateau period, v) add said difference to one of two accumulators depending on whether said actual motor velocity after said predetermined time is greater than or less than said threshold velocity, vi) reverse direction of said motor and repeating steps (iv) to (vi) until either of said two accumulators reach predetermined threshold values, and vii) determine whether said suitable fluid level has been reached based on the contents of said accumulators.

14. A laundry washing machine as claimed in claim 13 also including fluid level measuring means, and upon an amount of washing fluid entering said water container sufficient to float said spin tub and said laundry load out of connection with said agitator said spin tub and agitator are disconnected to allow said independent rotation and said step of obtaining an initial indication of said laundry load comprises said fluid level determining means determining the level of washing fluid in said water container at the moment disconnection occurs and transmitting said level at disconnection to said control means.

15. A laundry washing machine as claimed in claim 13 or claim 14 wherein said controller also executes the step of monitoring said laundry washing machine for changes in said load of laundry and upon determination of a change in said load repeating steps (iii) and (iv) to determine a new suitable fluid level.

16. A laundry washing machine as claimed in claim 15 wherein said step of obtaining an initial indication of the load of said laundry includes the step of admitting washing fluid to said water container while slowly rotating said spin tub and said agitator.

17. A laundry machine as claimed in claim 13 or claim 14 wherein said step of adding said difference to one of two accumulators is only carried out if said difference is below a predetermined limit.

18. A method of determining a suitable fluid level for washing a load of laundry in a laundry washing machine as claimed in claim 1 or claim 2 wherein said control means determines that said suitable fluid has been reached if the contents of the accumulator receiving positive velocity differences reaches its predetermined threshold limit.

19. A method of determining a suitable fluid level for washing a load of laundry in a laundry washing machine as claimed in claim 1 or claim 2 wherein if said control means determines that said suitable fluid level has not been reached in step (vii) then said method also comprises the subsequent step of viii) admitting an additional quantity of washing fluid to said water container and repeating step (i) to (viii).

20. A laundry washing machine as claimed in claim 13 or claim 14 wherein if said control means determines that said suitable fluid level has been reached if the contents of the accumulator receiving positive velocity differences reaches its predetermined threshold limit.

21. A laundry washing machine as claimed in claim 13 or claim 14 wherein if said control means determines that said suitable fluid level has not been reached in step (vii) then said program also causes said controller to viii) admit an additional quantity of washing fluid to said water container and repeating step (i) to (viii).

* * * * *

UNITED STATES PATENT AND TRADEMARK OFFICE

CERTIFICATE OF CORRECTION

PATENT NO. : 5,768,728

DATED : June 23, 1998

INVENTOR(S) : Jonathan David Harwood and Paul Stephen Hood

It is certified that error appears in the above-indentified patent and that said Letters Patent is hereby corrected as shown below:

Column 2, Line 21 "JP61-273487" should be -- JP61-263487 --

Signed and Sealed this

Eighth Day of December, 1998

Bruce Lehman

*Attest:*

BRUCE LEHMAN

*Attesting Officer*

*Commissioner of Patents and Trademarks*